US006974957B2

(12) United States Patent
Glukhoy

(10) Patent No.: US 6,974,957 B2
(45) Date of Patent: Dec. 13, 2005

(54) IONIZATION DEVICE FOR AEROSOL MASS SPECTROMETER AND METHOD OF IONIZATION

(75) Inventor: Yuri Glukhoy, Irwin, PA (US)

(73) Assignee: Nanomat, Inc., N. Huntingdon, PA (US)

( * ) Notice: Subject to any disclaimer, the term of this patent is extended or adjusted under 35 U.S.C. 154(b) by 70 days.

(21) Appl. No.: 10/782,122

(22) Filed: Feb. 18, 2004

(65) Prior Publication Data

US 2005/0178975 A1 Aug. 18, 2005

(51) Int. Cl.[7] ..... H01J 27/00
(52) U.S. Cl. ..... 250/427; 250/288; 250/292
(58) Field of Search ..... 250/288, 287, 250/281, 282, 427

(56) References Cited

U.S. PATENT DOCUMENTS

| | | | | |
|---|---|---|---|---|
| 5,382,794 | A * | 1/1995 | Downey et al. | 250/288 |
| 5,396,065 | A | 3/1995 | Myerholtz et al. | |
| 5,753,909 | A | 5/1998 | Park et al. | |
| 5,756,996 | A | 5/1998 | Bier et al. | |
| 5,825,025 | A | 10/1998 | Kerly | |
| 5,907,154 | A | 5/1999 | Shimomura | |
| 6,040,574 | A * | 3/2000 | Jayne et al. | 250/288 |
| 6,107,625 | A | 8/2000 | Park | |
| 6,198,096 | B1 | 3/2001 | Cocq | |
| 6,271,527 | B1 | 8/2001 | Chutjian | |
| 6,300,626 | B1 | 10/2001 | Brock et al. | |
| 6,410,915 | B1 * | 6/2002 | Bateman et al. | 250/288 |
| 6,524,803 | B2 | 2/2003 | Overney et al. | |
| 6,593,570 | B2 * | 7/2003 | Li et al. | 250/290 |
| 6,629,508 | B2 * | 10/2003 | Dykstra | 118/723 CB |
| 6,649,907 | B2 * | 11/2003 | Ebeling et al. | 250/288 |
| 6,809,318 | B2 * | 10/2004 | Krutchinsky et al. | 250/292 |

OTHER PUBLICATIONS

U.S. Appl. No. 10/58,153, filed Jul. 2003, Glukhoy.
Reece Roth: vol. 1, Institute of Physics, Publishing, Bristol and Philadelphia, 1992, pp. 206-218.
G. Wilhelmi, et al., "Binary Sequences and Error Analysis for Pseudo-Statistical Neutron Modulators With Different Duty Cycles", Nuclear Inst. and Methods, 81 (1970), pp. 36-44.

* cited by examiner

*Primary Examiner*—Nikita Wells
*Assistant Examiner*—Johnnie L Smith, II

(57) ABSTRACT

The ionization device of the present invention is intended for use in conjunction with an aerosol TOF MS operating in a continuous mode and is capable of ionizing particulated substances in a wide range of particle masses. In the illustrated embodiment, the ionization unit consists of three coaxial cylindrical bodies having a three aligned longitudinal slits for directing electron beams from externally located electron gun onto the axially arranged flow of droplets. The cylindrical bodies are connected to voltage sources so that the external cylindrical body functions as an anode that extracts electrons from the current-heated filament. The central cylindrical body, in combination with the aforementioned anode, serves as an electron-energy control member for precisely controlling and selecting the energy of electrons that reach the flow of particles, while the inner cylindrical body functions as a decelerating member that can be used for adjusting energy of electrons which reached the flow of particles. The heated filament of each electron gun, which is used as a source of electrons, is inclined with respect to the aforementioned longitudinal axis whereby modulation applied to the elongated outer electrode of the electron gun provides different ionization conditions for specific particles of predetermined masses for analysis of which the aerosol TOF MS is tuned.

33 Claims, 5 Drawing Sheets

IONIZATION DEVICE FOR AEROSOL MASS SPECTROMETER AND METHOD OF IONIZATION

FIELD OF THE INVENTION

The present invention relates to the fields of measurement instruments, in particular to mass spectrometers used for analyses of substances based on results of determination of masses of their ions or spectra of masses. More specifically, the invention relates to ionization devices used in aerosol mass spectrometers of a time-of-flight type with improved sensitivity and resolution and for operating in a real time. The invention also relates to a novel and efficient method of ionization of particles supplied to an aerosol mass spectrometer operating in s continuous mode.

BACKGROUND OF THE INVENTION

In order to understand the structure, principle of operation, and function of an ionizer used in a mass spectrometer, and in particular, in a time-of-flight type aerosol mass spectrometer for which the ionizer of the present invention is intended, it would be advantageous to get familiarized with aerosol mass spectrometers and their present use in the control of environment.

An important aspect of environmental control is monitoring the Earth's atmosphere and water basins. Atmospheric aerosols that are contained in the Earth's atmosphere play important roles in climatology and visibility as they absorb and scatter solar radiation. They also may affect human health when they penetrate the human body via the respiratory tracts. Therefore, there have been increased efforts aimed at better characterization of chemical and microphysical properties of aerosol to help elaborate appropriate particulate matter emission standards. Understanding of properties and behavior of atmospheric aerosols is also extremely important for studying the Earth's climate and potential detrimental impact of the aerosols on air quality and human health.

Control of water consists of flow routing along the river network, especially in connection with human activity, surveying of hydrological processes of land-atmospheric interaction such as evapotranspiration and snowmelt, control of sediment and pollutant transport in the streams, etc. It is not less important to control the pollution of water in seas and oceans, especially in the populated coastal areas. The protection of the water supplies is an important goal also for Homeland Defense to prevent a pandemic disaster. A future terrorist tactic could include dispersing of the poison containing ampoules can be triggered by remote control. The ampoules could be moved invisibly underwater and put in the bottom of the reservoir.

An instrument which is normally used for controlling environmetal conditions of water and gases is an aerosol mass spectrometer. Irrespective of whether the samples are taken from water or air, a mass spectrometer per se operates with dry particles or dried droplets. In the case when samples are taken from water, prior to admission into the vacuum chamber of the mass spectrometer, the samples are pretreated to form a stream of dried descrete particles. The samples are dried even if they are taken from moisture-containing air. Since the present invention relates to an ionization device of an aerosol mass spectrometer and since the particles or droplets to be charged in the ionizer are already in a dry state, the following analysis of the prior art will relate merely to aerosol mass spectrometers without disctinction between those taking samples from water or the atmosphere.

A typical aerosol mass spectrometer consists of the following parts: a sample inlet unit with a system for preparation and introduction of a substance to be analyzed into the instrument; a source of particles; an ionization device where the aforementioned particles are charged and formed into an ionized paricle flow; a mass analyzer where the charged particles are separated in accordance with an M/Z ratio, focused, and are emitted from the particle source in various directions within a small space angle; a charged-particle receiver or collector where current of charges is measured or converted into electrical signals; and a device for amplification and registration of the output signal. In addition to amount of charged-particles (ion current), the registration unit also receives information about charged-particle mass. Other units included into a mass spectrometer are power supplies, measurement instruments, and a vacuum system. The latter is required for maintaining the interior of the mass spectrometer under high vacuum, e.g. of about $10^{-3}$ to $10^{-7}$ Pa. Operation is normally controlled by a computer, which also stores the acquired data.

According to coomon understanding, ions are defined as charged atoms or molecules of a substance. However, since in the ionizer of the present invention works not only with ions but also with larger particles that may be aggregated from thousands or more than thousands of molecules, where approriate, instead of the word "ion", we will use the word "particle" which covers both the ions and particles larger than ions. In some instances the word "ion" will be still used in compliance with the generally used terminology. For example, the word "ion" is present in the term: "ionizer" itself or in the word "ionization" that means charging of particles.

A mass spectrometer is characterized by its resolution capacity, sensitivity, response, and a range of measured masses. The aforementioned response is a minimal time required for registration of mass spectrum without the loss of information within the limits of so-called decade of atomic mass units (1–10, 10–100, etc.). Normally such time is 0.1 to 0.5 sec. for static mass spectrometers and $10^{-3}$ for dynamic (time-of-flight) mass spectrometers.

A substance to be analyzed is introduced into a mass spectrometer with the use of so-called molecular or viscous flow regulators, load ports, etc.

By methods of ionization, particle sources of mass spectrometers can be divided into various categories, which are the following: 1) ionization caused by collisions with electrons; 2) photo-ionization; 3) chemical ionization due to ionic-molecular reactions; 4) field ion emission ionization in a strong electric field; 5) ionization due to collisions with charged paricles; 6) atomic-ionization emission due to collisions with fast atoms; 7) surface ionization; 8) spark discharge in vacuum; 9) desorption of ions under effect of laser radiation, electron beam, or products of decomposition of heavy nuclei; and 10) extraction from plasma.

In addition to ionization, an ionization device used in a mass spectrometer is used also for forming and focusing a flow of the charged particles.

More detail general information about types and constructions of sources of charged particles suitable for use in mass spectrometers can be found in "Industrial Plasma Engineering" by Reece Roth, Vol. 1, Institute of Physics Publishing, Bristol and Philadelphia, 1992, pp. 206–218.

By types of analyzers, mass spectrometers can be divided into static and dynamic. Static mass spectrometers are based on the use of electric and magnetic fields which remain, during the flight of charged particles through the chamber, practically unchanged. Depending on the value of the M/Z ratio, the charged particles move along different trajectories. More detailed description of static and dynamic mass spectrometers is given in pending U.S. patent application Ser. No. 10/058,153 filed by Yu. Glukhoy on Jan. 29, 2002.

It should be noted that static mass spectrometers are static installations which are heavy in weight, complicated in construction, and operation with them requires the use of skilled personnel.

In time-of-flight mass spectrometers, charged particles formed in the ionizer are injected into the analyzer via a grid in the form of short pulses of charged-particle current. The analyzer comprises an equipotential space. On its way to the collector, the pulse is decomposed into several sub-pulses of the charged-particle current. Each such sub-pulse consists of charged particles with the same e/m ratios. The aforementioned decomposition occurs because in the initial pulse all charged particles have equal energies, while the speed of flight V and, hence, the time of flight t through the analyzer with the length equal to l are inversely proportional to $m^{1/2}$:

$$T=L(m/2\ eV)^{1/2}.$$

A series of pulses with different e/m ratios forms a mass spectrum that can be registered, e.g., with the use of an oscilloscope. Resolution capacity of such an instrument is proportional to length L.

An alternative version of the time-of-flight mass spectrometer is a so-called mass-reflectron, which allows an increase in resolution capacity due to the use of an electrostatic mirror. Energies of charged particles collected in each packet are spread over the temperature of the initial gas. This leads to broadening of peaks on the collector. Such broadening is compensated by the electrostatic mirror that prolongs the time of flight for slow charged particles and shortens the time of flight for fast charged particles. With the drift path being the same, the resolution capacity of a mass reflectron is several times the resolution capacity of a conventional time-of-flight mass spectrometer.

In the charged particle source of an RF mass spectrometer, charged particles acquire energy eV and pass through a system of several stages arranged in series. Each stage consists of three spaced parallel grids. An RF voltage is applied to the intermediate grid. With the frequency of the applied RF field and energies eV being constant, only those charged particles can pass through the space between the first and intermediate grids that have a predetermined M/Z ratio. The remaining charged particles are either retarded or acquire only insignificant energies and are repelled from the collection by means of a special decelerating electrode. Thus, only charged particles with the selected M/Z ratio reach the collector. Therefore, in order to reset the mass spectrometer for registration of charged particles with a different mass, it is necessary either to change the initial energy of a flow of charged particles, or frequency of the RF field.

Magnetic resonance mass analyzers operate on a principle that the time required for charged particles to fly over a circular trajectory will depend on the charged-particle mass. In such mass analyzers, resolution capacity reaches $2.5\times10^4$.

The last group relates to ion-cyclotron resonance mass spectrometers in which electromagnetic energy is consumed by charged particles, when cyclotron frequency of the charged particles coincides with the frequency of the alternating magnetic field in the analyzer. The charged particles move in a homogeneous magnetic field B along a spiral path with so-called cyclotron frequency $\omega_c$= eB/mc, where c is velocity of light. At the end of their trajectory, the charged particles enter the collector. Only those charged particles reach the collector, the cyclotron frequency of which coincides with that of the alternating electric field in the analyzer. It is understood that selection of charged particles is carried out by changing the value of the magnetic field or of the frequency of the electromagnetic field. Ion-cyclotron resonance mass spectrometers ensure the highest resolution capacity. However, mass spectrometers of this type require the use of very high magnetic fields of high homogeneity, e.g., of 10 Tesla or higher. In other words, the system requires the use of super-conductive magnets which are expensive in cost and large in size.

In a quadrupole mass spectrometer, charged particles are spatially redistributed in a transverse electric field with a hyperbolic distribution of the electric potential. This field is generated by a quadrupole capacitor having a D.C. voltage and RF voltage applied between pairs of rods. The flow of charged particles is introduced into a vacuum chamber of the analyzer in the axial direction of the capacitor via an input opening. With the frequency and amplitude of the RF field being the same, only charged particles with a predetermined M/Z ratio will have the amplitude of oscillations in the transverse direction of the analyzer shorter than the distances between the rods. Under the effect of its initial velocity, such charged particles will pass through the analyzer and will be registered and reach the collector, while all other charged particles will be neutralized on the rods and pumped out from the analyzer. Reset of such mass spectrometer to charged particles of another mass will require to change ether the amplitude or the frequency of the RF voltage. Quadrupole mass spectrometers have resolution capacity equal to or higher than $10^3$.

Attempts have been made to improve existing mass spectrometers of the time-of-flight type, e.g., by improving charged-particle storage devices, introducing deflectors for selection of charged-particle for analysis in a mass spectrometer, reorganizing sequencing of charged-particle packets or by extending the time of flight for improving resolution capacity of the mass spectrometers.

For example, U.S. Pat. No. 5,396,065 issued in 1995 to C. Myerholtz, et al. discloses an encoded sequence of charged-particles in packets for use in time-of-flight mass spectrometers, in which the high-mass charged particles of a leading packet will be passed by the low-mass charged particles of a trailing packet. Thus, a high efficiency time-of-flight mass spectrometer is formed. The charged particles of each packet are acted upon to bunch the charged particles of the packet, thereby compensating for initial space and/or velocity distributions of charged particles in the launching of the packet. The times of arrival of the charged particles are determined at the detector to obtain a signal of overlapping spectra corresponding to the overlapping launched packets. A correlation between the overlapping spectra and the encoded launch sequence is employed to derive a single non-overlapped spectrum.

However, such method and apparatus make interpretation of obtained data more complicated and not easily comprehensible. Furthermore, addition electronic circuits are required for control of the charged particle packet sequence.

U.S. Pat. No. 5,753,909 issued in 1998 to M. Park et al. describes a method and apparatus for analyzing charged particles by determining times of flight including using a collision cell to activate charged particles toward fragmentation and a deflector to direct charged particles away from their otherwise intended or parallel course. Deflectors are used as gates, so that particular charged particles may be selected for deflection, while others are allowed to continue along their parallel or otherwise straight path, from the charged-particle source, through a flight tube, and eventually, to a detector. A post-selector, in the form of two deflection plates is used as charged-particle deflector and is encountered by charged particles after the collision cell as they progress through the spectrometer.

A disadvantage of the device disclosed in U.S. Pat. No. 5,753,909 consists in that this mass spectrometer is based on the selection of specific charged particles and does not show the entire mass spectrum. For obtaining the entire spectrum, it is necessary to perform step by step scanning, and this requires an additional time.

U.S. Pat. No. 6,107,625 issued in 2000 to M. Park discloses a coaxial multiple reflection time-of-flight mass spectrometer of a time-of-flight type with resolution capacity improved due to a longer time of flight of the charged particles. The apparatus comprises two or more electrostatic reflectors positioned coaxially with respect to one another such that charged particles generated by a charged-particle source can be reflected back and forth between them. The first reflecting device is a charged-particle accelerator which functions as both an accelerating device to provide the initial acceleration to the charged particles and a reflecting device to reflect the charged particles in the subsequent mass analysis. The second reflecting device is a reflectron which functions only to reflect the charged particles in the mass analysis. During the mass analysis, the charged particles are reflected back and forth between the accelerator and reflectron multiple times. Then, at the end of the charged-particle analysis, either of the reflecting devices, preferably the charged-particle accelerator, is rapidly de-energized to allow the charged particles to pass through that reflecting device and into a detector. By reflecting the charged particles back and forth between the accelerator and reflectron several times, a much longer flight path can be achieved in a given size spectrometer than could otherwise be achieved using the time-of-flight mass spectrometers disclosed in the prior art. Consequently, the mass resolving power of the time-of-flight mass spectrometer is substantially increased.

This is a typical system with storage of charged particles, which does not allow a continuous mode of mass analysis since it requires some period for de-energization of one of the reflecting devices. Obviously, the data is difficult to interpret, especially when masses of charged particles are scattered in a wide range so that light charged particles may undergo several reflections while heavy charged particles made only one or two reflections.

The most advanced time-of-flight mass spectrometer (TOF MS) that provides extended time of flight trajectory and hence the time resolution is a quadrupole mass spectrometer developed by Y. Glukhoy and described in aforementioned U.S. patent application Ser. No. 10/058,153. This is the first mass spectrometer known in the art that provides helicoidal trajectories of charged particles by using only electrostatic lens optics.

A mass spectrometer of the aforementioned patent application is based on the use of quadrupole lenses with an angular gradient of the electrostatic field from lens to lens. The device consists of a charged-particle source connected to a charged-particle mass separation chamber that contains a plurality of sequentially arranged electrostatic quadrupole lenses which generate a helical electrostatic field for sending charged particles along helical trajectories in a direct and return stroke. Scattering of positions of points of return is reduced by means of electrostatic mirrors located at the end of the direct stroke, while charged particles of different masses perform their return strokes along helical trajectories different from those of the direct strokes due to the use of a magnetic and/or electrostatic mirrors.

A particle-electron emitting screen is installed on the path of charged particles in the reverse stroke, and positions of collision of the charged particles with the particle-electron emitting screen over time and space are detected with the use of micro-channel plate detectors. Movement of charged particles along the helical trajectory significantly increases the path of charged particles through the charged-particle separation chamber and, hence, improves the resolution capacity of the mass spectrometer.

However, the above-described helical-path quadrupole mass spectrometer, as well as all aforementioned known mass spectrometers of other types, is not very convenient for aerosol applications. This is because in some applications the aerosol analysis should be carried out with sampling and inputting of the aerosol substance into the mass-analyzing unit in a continuous mode. At the same time, all aforementioned apparatuses have a low-duty cycle and are characterized by a limited particle input, i.e., they have a single injection port for inputting particles to be analyzed into the ionization of a mass spectrometer.

It should be noted that the use of mass spectrometers has come under scrutiny in recent years as a possible solution for a high-speed detection of the aerosol particles in the panorama mode. It can be used for early detection and real-time analysis of aerosol particles in the situation of the large area contamination after the chemical and biological attack or accident, or for general-purpose field, e.g., for monitoring of ozone-consuming organic materials, or the like.

However, the sensitivity of conventional TOF MS is affected by the aforementioned low duty-cycle, meaning only small fraction of charged particles originally in the continuous flow of charged particles is converted into the charged-particle packets and participates in the registration by the charged-particle detectors. Most of the charged particles are discarded from registration during "pulse and wait" time.

It should be recalled that an aerosol TOF MS is supposed to combine several processes which are the following: collection and preparation of samples to a form acceptable for mass spectroscopy; electron impact ionization; bunching of charged particles upon application of an electrical pulse to the gating electrode (usually a charged grid) i.e., conversion of the continuous flow of charged particles into the charged-particle packets; collimation of the flow of charged particles by introducing these charge-particle packets into the charged-particle flight region; traveling of the charged particles in the long drift tube; detecting the charged particles impinging the multi-channel plates; and analyzing the obtained data.

In all known aerosol TOF MS's, a significant amount of sample material is wasted. Usually 98% of the sample is lost during passing trhough the nozzle, skimmer's collimation, electron impact ionization and the entrance aperture. These losses are unavoidable. But others can be reduced significantly. For example, traveling losses due to collisions with molecules of the residual gas can be reduced by improving the vacuum and reducing the length of the drift tube. This objective was achieved in aforementioned U.S. patent application Ser. No. 10/058,153 due to the use of an extended doubled and helical trajectory of the particles.

It should be noted, that analysis conducted in a conventional aerosol TOF MS requires that the continuous flow of particles be interrupted. Otherwise, it would be impossible to perform selection and tracing of individual particles for which the time-of-flight and, respectively, spectra of masses, have to be determined. However, in conventional aerosol TOF MS, bunching, i.e., in a process that extracts particles from a continuous charged-particle flow, is insufficient and therefore in some cases leads to the loss of very important information and hence to decrease in the sensitivity of the TOF-MS as whole. To increase the signal-to-noise ratio, such conventional systems use expensive amplifiers and logistical systems.

Conventionally, the stream of charged particles is divided into packets of ions that are launched along the propagation path using a traditional "pulse-and-wait" approach. The second packet can't be launched before all charged particles from the first packet reach the charged-particle detector in order to prevent overlapping of signals. Because each packet can contain only a few charged particles of the species of the materials, the experiment has to be repeated many times. So, it is impossible to reach in the condition of the flight the quality of the measurement that is sufficient to identify the aerosol compound using a conventional TOF MS. In other words, conventional TOF MS's have a limited low duty cycle, and the authors are not aware of any known means that can increase the duty cycle above 60%.

For measurement of masses of particles, the data obtained in an aerosol TOF MS must be analyzed. Heretofore, different methods have been used for reconstruction of the particle distribution spectra in acquisition period of the cycle. Such methods are described e.g., by the following authors: 1) G. Wilhelmi, et al. in "Binary Sequences and Error Analysis for Pseudo-Statistical Neutron Modulators with Different Duty Cycles," Nuclear Inst. and Methods, 81 (1970), pp. 36–44; 2) Myerholtz, et al. "Sequencing ion packets for ion time-of-flight mass spectrometry" (see aforementioned U.S. Pat. No. 5,396,065 described earlier in the description of the prior art); 3) Cocg "High duty cycle pseudo-noise modulated time-of-flight mass spectrometry" (U.S. Pat. No. 6,198,096, issued Mar. 6, 2001; 4) Brock, et al. "Time-of-flight mass spectrometer and ion analysis" (U.S. Pat. No. 6,300,626, issued Oct. 9, 2001); 5) Overney, et al. "Deconvolution method and apparatus for analyzing compounds" (U.S. Pat. No. 6,524,803, issued Feb. 25, 2003), etc.

The above methods utilize special properties of the pulsing sequence, e.g., a pseudo-random binary sequence (PRBS) or Hadamard Transform. However, they cannot reach a high duty-cycle because their TOF MS's annihilate a part of the flow of charged particles by a gating grid [see references 3) and 4)] or deflecting mesh [see reference 5)] during binary modulation that they converted. This is because at least a half of the charged-particle flow must be discarded to allow the other half to be counted. The flow of charged particles sputters and contaminates the modulation grids or meshes and creates secondary electron-, ion-, or photon-emission leading to deterioration of the grids. Furthermore, foreign species introduced in the drift space because of contamination and sputtering destruct the detectors and distort the information. The low sensitive flat deflection system, which is used in the in the A. Brock et al TOF-MS for the Hadamard's transform, contains a high density array of the wires with alternating potential that leads to breakdown.

So the conventional TOF-MS's with the pseudo-random binary methods of bunching of the ion packets can not provide high duty cycle, have low sensitivity and reliability, and cannot serve properly as monitoring devices for field applications because of the incorrect choice and design of the ion optics and the irrational bunching strategy.

The disadvantages of the known aerosol TOF MS's make them unsuitable for aforementioned real-time analysis under extreme or critical conditions such a biological attack or an environmental disaster, e.g., a hazardous leakage or contamination of water reservoirs in populated areas.

It is known that in order to analyze a substance with the use of a mass spectrometer, and hence, with the use of a TOF MS, which is one type of the mass spectrometers, the substance to be analyzed has to be subjected to ionization. Ionization is a process of converting electrically neutral atomic particles into positive ions and free electrons. This is achieved by removing one or several electrons from the molecule of the substance. Herein, the term "ionization" means elementary ionization of individual atoms and molecules as well as simultaneous ionization of a plurality of atoms and molecules in a certain volume.

Having described various types of mass spectrometers, let us refer now to ionization devices used in mass spectrometers. The following methods of ionization are known: 1) collisional ionization (collision of electrons with atoms and molecules); 2) ionization caused by exposure to light (photoionization); 3) electric field ionization (ionization under the effect of an electric field). The collisional ionization is suitable for ionization in gases and plasma. Elementary ionization is characterized by an effective cross section of ionization that depends on the type of collided particles, their quantum states, and velocities of relative movements. Photoionization is ionization of particles caused by absorption of photons by atoms and molecules, while electric field ionization, which is also known as autoionization, is ionization of atoms and molecules under the effect of a strong electric field. There are some more exotic forms of ionization such as chemical ionization that results from chemical reactions, near-surface ionization, etc.

All ionization devices used in mass spectrometers are based on one or on a combination of the aforementioned methods of ionization. In fact, a great variety of ionizers is known and used in the industry. A large group of ionizers is based on a principle according to which a substance to analyzed is first converted into plasma, which in ionization is used as a source of ions. The ionizers of this group are described in great detail in Chapter 6 of "Industrial Plasma Engineering" by J. Reece Roth, Institute of Physics Publishing, 1995. The ionizers that constitute this group differ from each other mainly by mechanisms used for igniting and sustaining plasma of gas discharge as well as by methods used for extracting ions from the plasma volume. However, ionizers contained in this gas discharge or plasma type group are not applicable for aerosol mass spectrometers for a number of reasons. Some ionizers have short service life, e.g., those with capillary charge. Others have a very cumbersome and complicated structure. Thirds have non-adjustable parameters, i.e., they are inapplicable for conditions where masses of particles vary in a wide range, etc.

Ionizers based on photoionization, in particular on ionization of samples by laser that at the present time find wide application in the industry, especially in matrix-assisted laser desorption ionization (MALDI) mass spectrometry that was developed at the end of $80^{th}$. However, a problem that may occur in application of MALDI processes to aerosol mass spectrometry is that it would be difficult to preserve mass and charge ratio of particles irradiated or treated by a laser beam. It is especially important for time-of-flight mass spectrometers, the operation of which is based on determining the time of flight of particles that depends on their mass and charge.

U.S. Pat. No. 5,756,996 issued in 1998 to Mark Bier, et al. discloses an external ion source assembly in which ions are formed in an ion volume by the interaction of energetic electrons and gas molecules. This is a good example of collisional ionization. The effective energy of the electrons entering the ion volume is controlled by changing the voltage between the electron source (filament) and the ionization volume whereby ions having sufficient energy for ionizing atoms and molecules leave the electron source and enter the ionization volume only during an ionization period.

U.S. Pat. No. 5,825,025 issued in 1998 to Eric Kerly discloses a miniaturized time-of-flight mass spectrometer having a minimized flight path of sample ions between a repeller and a detector in order to minimize the overall size of the time-of-flight mass spectrometer (TOF-MS), thereby requiring a reduced vacuum capacity. The TOF-MS includes an ionizer, in which a sample to be tested is placed. An electron gun is provided for emitting electrons through the ionizer to the sample, thus ionizing the sample. An input lens comprising a plurality of electrodes is provided for collimating the ions freed from the sample and directing the collimated ions toward an accelerator region. To reduce lateral velocity spread in the incoming ion beam, the input lens is set to have its input focal point at the point of ionization. A repeller is pulsed to push the ions toward a detector in the TOF-MS. The ions travel through a plurality of grids provided to maintain a linear electric field and into the flight tube. The grids are oriented such that at least the initial portion of the flight path is at a right angle with respect to the ion beam emitted from the input lens. Deflectors are provided within the flight tube for compensating lateral velocity components. The grids are spaced dependant upon the flight path length, and the potentials of each grid are selected such that performance is optimized.

U.S. Pat. No. 5,907,154 issued in 1999 to Manabu Shimomura describes an ionization device that comprises: an ionization chamber in which sample molecules are ionized: an electrode such as a repeller electrode affixed to the ionization chamber through an insulating holder member having a surface exposed to the interior of the ionization chamber; and a detector for detecting the changes in the resistance of this insulating holder member. As contaminants are deposited on the inner walls of the ionization chamber, they are also deposited on the exposed surface of the insulating holder member, affecting the resistance value of the insulating holder member. The level of contamination inside the ionization chamber can be estimated by monitoring the output of the detector. The device of this patent is a good example of an ionizer equipped with means for preventing admission of non-charged particles (contaminants) into the mass spectrometer.

U.S. Pat. No. 6,271,527 issued in 2001 to Ara Chutjian discloses an improved electron ionizer for use in a quadrupole mass spectrometer. The improved electron ionizer includes a repeller plate that ejects sample atoms or molecules, an ionizer chamber, a cathode that emits an electron beam into the ionizer chamber, an exit opening for excess electrons to escape, at least one shim plate to collimate said electron beam, extraction apertures, and a plurality of lens elements for focusing the extracted ions onto entrance apertures.

A common disadvantage of all these known ionization devices is that they are not applicable for use in an aerosol mass spectrometer operating in real time and either do not allow control of the residence time of particles while they are ionized in the ionization device, or destroy multimolecular particles which are to be analyzed. If the residence time of the particles in the ionization device is not controlled, heavy particles that possess large masses may be subjected to multiple charging. This will create problems for identification of particles by masses. On the other hand, defragmentation of large particles also makes identification of particles by mass more complicated and unacceptable, especially in analysis of particles of a chemical and biological nature.

SUMMARY OF THE INVENTION

It is an object of the present invention to provide an ionization device which is applicable for use in an aerosol mass spectrometer operating in real time and allows control of the residence time of particles while they are ionized in the ionization device. Another object is to provide an ionization device of the aforementioned type that does not destroy multimolecular particles which are to be analyzed. Still another object is to provide an ionization device of the aforementioned type that ensures single-time charging of the particles. A further object is to provide an ionization device of the aforementioned type that identifies particles by masses in a wide range of mass variations from molecules, molecule fragments to multimolecular compounds and particles. It is another object of the invention to provide a novel and efficient method of ionization of particles supplied to an aerosol mass spectrometer operating in a continuous mode.

The ionization device of the present invention is intended for use in conjunction with an aerosol TOF MS operating in a continuous mode and is capable of ionizing particulated substances in a wide range of particle masses. The device consists of an input unit, into which a flow of particles is supplied from the sampling unit, an ionization unit where particles are ionized by collision with electrons, and outlet diaphragms through which a flow of ionized paricles or droplets is fed to the focusing optics of the TOF MS. In order to provide operation of the TOF MS in a continuos mode, the input unit of the ionization device comprises a rotary nozzle replacement carrier on the front end of the ionization device that carries a plurality of orifices which can be aligned with the direction of the flow and replaced by a new one upon contamination of the orifice passages without interruption for cleaning. The ionization unit consists of several, e.g., three coaxial cylindrical bodies having several, e.g., three aligned longitudinal slits on their outer surfaces, which extend in the directions parallel to the central axis of the cylindrical bodies. The radially aligned sets of the cylindrical bodies form electrostatic slit lenses. The device is provided with elongated electron guns, which are located outside the external cylindrical body in alignment with each set of slits and form flat electron beams, the planes of which are arranged radially and have a line of intersection along the longitudinal axis of the flow of particles. The cylindrical bodies are connected to voltage sources so that the external cylindrical body functions as an anode that extracts electrons from the current-heated filament. The central cylindrical body, in combination with the aforementioned anode, serves as an electron-energy control member for precisely controlling and selecting the energy of electrons that reach the flow of particles, while the inner cylindrical body functions as a decelerating member that can be used for adjusting energy of electrons which reached the flow of particles. The heated filament of each electron gun, which is used as a source of electrons, is inclined with respect to the aforementioned longitudinal axis whereby modulation applied to the elongated outer electrode of the electron gun provides different ionization conditions for specific particles of predetermined masses for analysis of which the aerosol TOF MS is tuned. This is achieved by providing different distribution of density of electrons along the filament which, in turn, is achieved by inclination of the filaments and application of the adjustable modulated voltage to the external electrode of the electron gun relative to the filament.

DETAILED DESCRIPTION OF THE INVENTION

Figure 1:
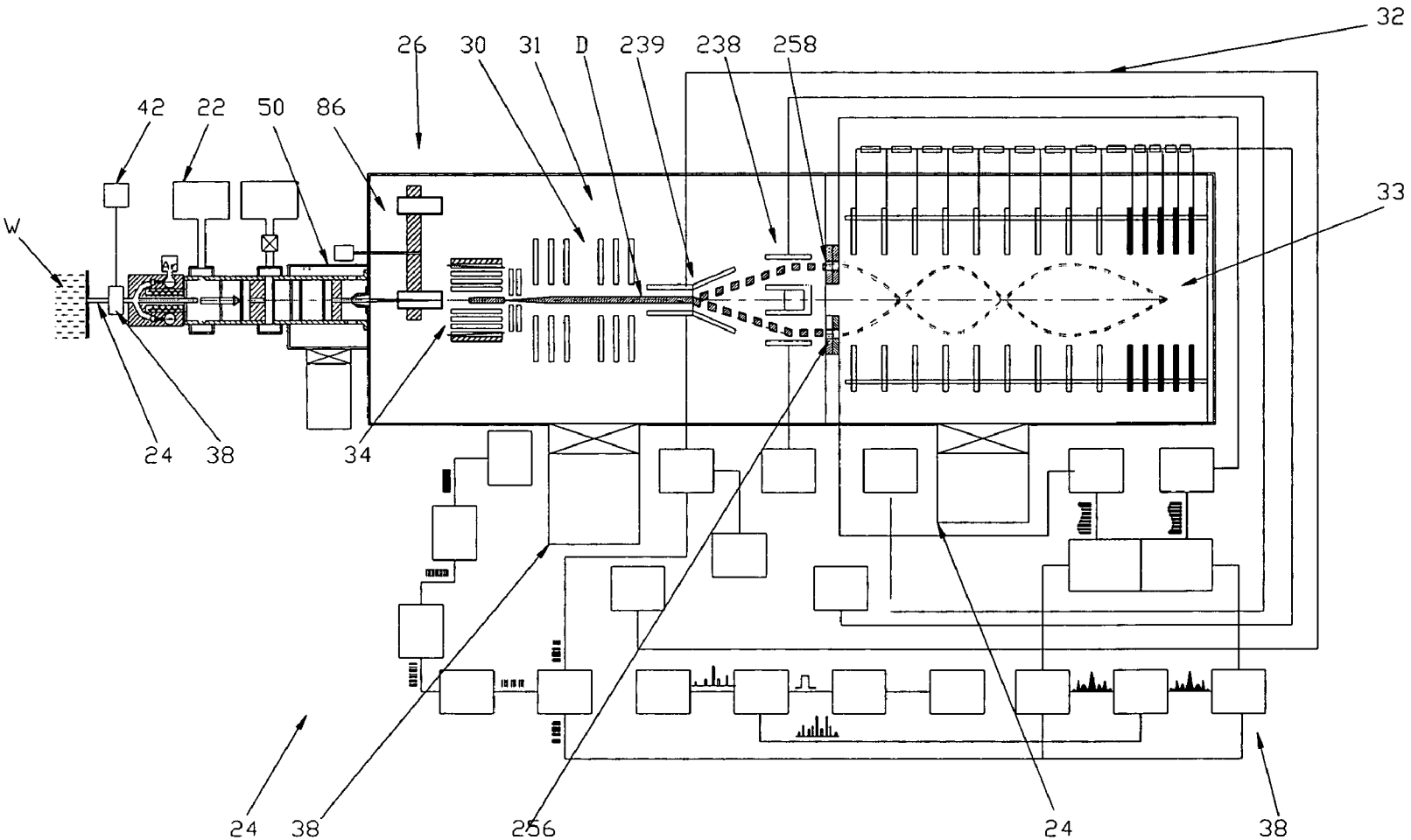
FIG. 1 is a schematic view of an aerosol TOF MS that incoporates an ionization device of the present invention.

A schematic view of an aerosol TOF MS of the present invention, which in general is designated by reference numeral 20 and incorporates an ionization device of the present invention, is shown in FIG. 1. The aerosol TOF MS 20 consists of the following main units arranged in sequence: 1) a sampling device 22 which produces trains of uniformly-sized and uniformly-spaced droplets D of a liquid that may contain a sought substance and is taken through an interface 24, e.g., from sea water; 2) an ionization device 26 which is connected to an output 28 of the sampling device 22 for receiving the aforementioned train of the uniformly-sized and uniformly-spaced droplets D which are ionized and focused during transportation through an ion-optic system 30; 3) an aerosol TOF MS unit 32 that receives on its input 34 the ionized and diverged train of droplets D, focuses this train of droplets, and distributes the droplets over their mass/charge ratio; and 4) data acquisition and analysis unit 36 that acquires, accumulates the data from the aerosol TOF MS unit 32 in a real-time mode, and analyses concentration and changes in concentration of a target substance in the investigated medium. Now, each of the aforementioned main units will be considered separately in more detail.

Sampling Unit

In the aerosol TOF MS of the invention, the principle of sampling is based on a device similar to the one disclosed in U.S. Pat. No. 5,345,079 issued in 1994 to J. French, et al. In accordance with the above patent, a liquid sample to be analyzed is fed to a micro pump. The pump directs the solution, as a stream of uniformly sized and spaced droplets, into a laminar stream of hot carrier gas. The carrier gas evaporates the solvents (e.g. water) in the droplets to form a stream of dried particles. The stream of particles can be then vaporized. Similar to the sampling unit of our invention, the sampling unit of U.S. Pat. No. 5,345,079 is intended for sending the stream of uniformly sized and spaced droplets to an ionization device and then to a mass spectrometer, or the vapor can be analyzed by optical spectroscopy.

Figure 2:
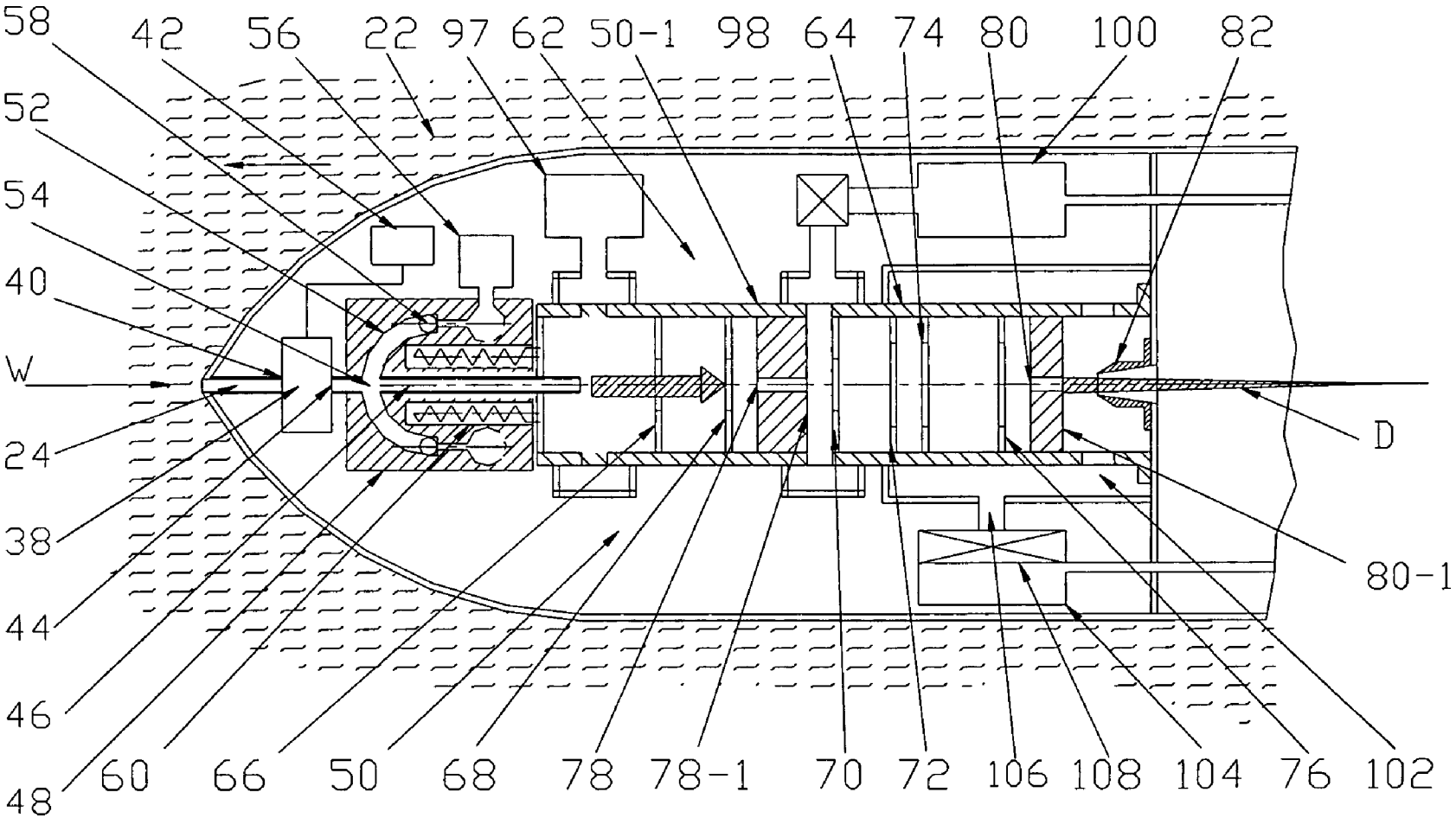
FIG. 2 is a sectional view of the sampling unit used in the TOF MS of FIG. 1 for sampling and preparing droplets for input into the ionizationd device of the present invention.

The sampling unit 22 of the aerosol TOF MS that utilizes the ionization device 26 of the present invention is shown in FIG. 2. This unit produces trains of uniformly-sized droplets D, and contains a micro pump 38, which has an inlet port 40 which is connected to the pump via the interface 24 (FIGS. 1 and 2), e.g., in the form of a pipe submerged into the investigated media such as sea water W. The micro pump 38 is connected to a signal source 42 for supplying the pump 38 with an electrical signal required for controlling the droplet repetition rate or frequency. The micro pump 38 has an outlet port 44 connected to a narrow tube 46 for ejecting droplets D at a velocity of between 2 and 4 meters per second. The aforementioned tube 46 is located over much of its length in a metal mixer block 48 at the entrance to an aerodynamic lens system 50, which will be described later.

The mixer block 48 (FIG. 2) contains an annular gas passage 52, which is concentric and coaxial with the tube 46. The passage 52 that joins the tube 46 and the place of joining, which in FIG. 2 is designated by reference numeral 54, is carefully shaped and smoothed to avoid turbulence. A carrier gas such as argon is supplied from a gas source 56 into the passage 52. The passage has a settling screens 58 that is intended for eliminating a local turbulence in the flow of carrier gas and maintains the flow under laminar conditions.

The mixer block 48 is provided with heater rods 60 that maintain the block 48 heated to a substantial temperature. The heater rods 60 are located in the metal annulus of the block 48 between the passage 52 and the tube 46. The heater rods 60 heat the flow that passes through the tube 46 for evaporation of water from the droplets D leaving a stream of dried micro particles that are injected together with argon into the aforementioned aerodynamic lens system 50 as a supersonic flow.

The sampling unit of the type disclosed in U.S. Pat. No. 5,345,079, as well as sampling units of all other mass spectrometers, introduces the flow of ionized particles directly to the vacuum chamber of a mass spectrometer without the use of any intermediate preparatory device. Therefore, the known combined ionizer/buffer/MS assemblies have short service life. This is because the inlet orifices for the introduction of the flow of droplets D to the TOF MS are quickly contaminated and clogged, so that the process has to be stopped and the orifice has to be cleaned or replaced. This drawback makes the aforementioned combination unacceptable for operation in a continuous mode for which the apparatus 20 (FIG. 1) of the present invention is intended. Means that are used in the apparatus of the invention for eliminating the above drawback will be described later.

The aerosol TOF MS 32 of the present invention (FIG. 1) is provided with an aerodynamic lens system 50 (FIGS. 1 and 2) located between the ionizer 22 and the mass spectrum unit 32. The aerodynamic lens system 50 is intended for improving control of particle sizing and for scanning the particle size. The structure and principle of operation of aerodynamic lenses suitable for the purposes of the present invention are disclosed in U.S. Pat. No. 6,259,101 issued in 2001 to A. Wexler, et al., U.S. Pat. No. 5,565,677 issued in 1996 to A. Wexler, et al., and in article by P. Middha, et al. "Particle Focusing Characteristics of Sonic Jets". Aerosol Sci. Technol. 37:907–915, 2003.

Figure 3A:
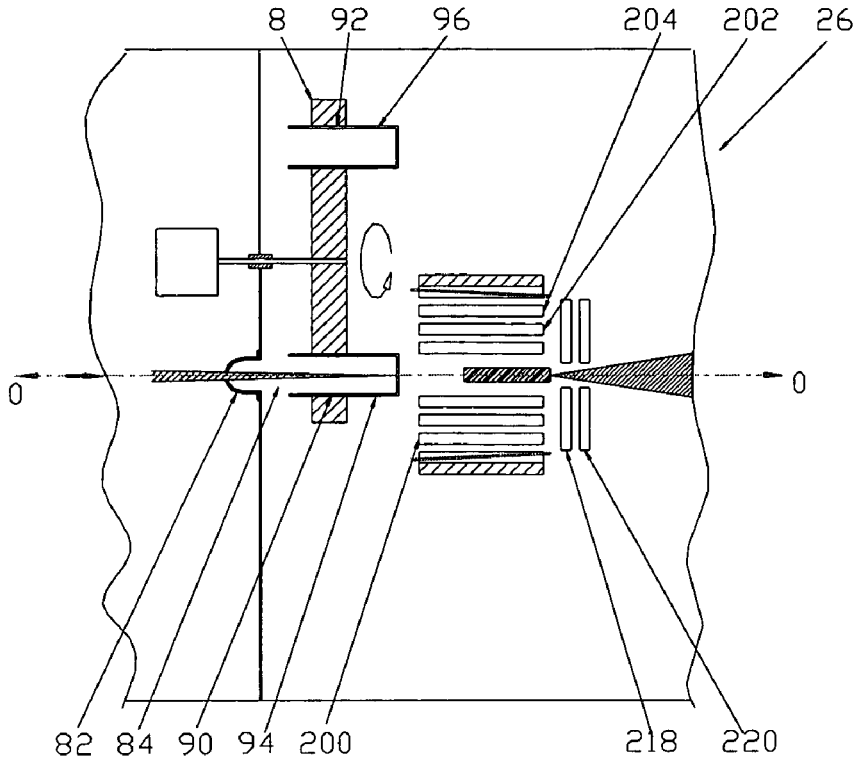
FIG. 3A is a longitudinal sectional view that illustrates arrangement of units in the ionization device of the present invention.
Figure 3B:
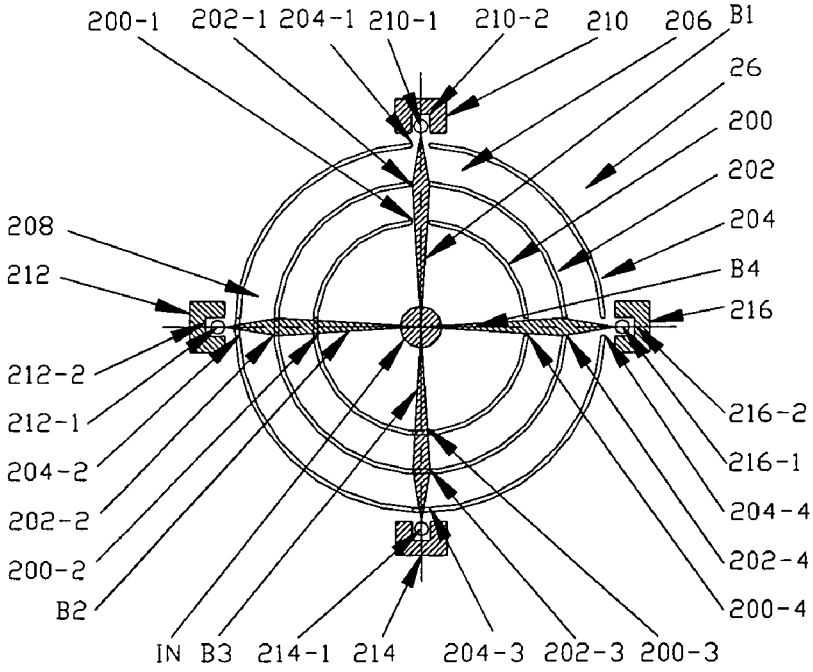
FIG. 3B is a view that illustrates a rotary nozzle replacement system located at the inlet to the ionizaion device of FIG. 3A.

The aerodynamic lens system 50 (FIG. 2) accomplishes the task of particle beam formation, which occurs under a reduced pressure, and utilizes two stages 62 and 64 arranged into a single column 50-1 (FIG. 2), a series of aerodynamic lenses 66, 68 in the first stage 62 and a series of aerodynamic lenses 70, 72, 74, and 76 in the second stage 64. The first stage 62 and the second stage 64 communicate through an orifice 78. The second stage 64 has on its outlet two sequentially arranged orifices, 80 and 82 which are coaxial to a cylindrical nozzle 84 installed on the periphery of a rotary nozzle replacement system 86 (the nozzle 84 and the system 86 are shown in FIGS. 3A and 3B which are described later). In fact, the rotary nozzle replacement system 86 belongs to another unit, i.e., the ionization device 26 of the invention which will be described in detail later. The orifice 82 functions as a final skimmer at the outlet from the second stage 64.

The above-described aerodynamic lens system 50 is quite effective in moving large particles to the centerline of the orifices 78, 80, 82, and 84. Beam divergence of small particles can be reduced by using a differentially pumped inlet. The deposition losses for medium size particles can be reduced using a transitional nozzle. For this, as has been describe above, the lenses are arranged with a decrease of the diameters of their openings in the flow propagation direction.

Although the aerodynamic lens system 50 was shown and described in FIGS. 1 and 2 with reference to a specific number of lenses, it is understood that any number of the stages and any number of lenses in each stage section can be used. While the diameters of the lens openings are reduced in the downflow direction, distances between these lenses are sequentially increased in the same directions.

The first stage 62 is preferably at atmospheric pressure, but if necessary to mach the pressure of the stage 62 with the pressure in the flow emitted through the tube 46, the apparatus is provided with a pump 97 (FIG. 2) which is connected to the first stage 62 and may adjust the pressure in this stage. Because of the provision of the lenses 66 and 68, the atmospheric pressure aerosol is formed into a flow F of droplets D where all of the droplets D are aligned. The beam then passes through an orifice 78 in the capillary unit 78-1 at the downstream end of the first stage 62. The diameter of the orifice 78 is less than the diameter of the opening in the aerodynamic lens 68.

A space between the end of the first stage 62 and the beginning of the second stage 64, or between the orifice 78 and the aerodynamic lens 70 is connected to a vacuum pump 100. The pump 100 functions to reduce the pressure to an intermediate pressure, such as 50 Torr in the second stage 64. In addition, much of the gas in the aerosol flow is removed by the pump 100 before the path enters the second stage 64.

After the particle beam passes through the second set of the aerodynamic lenses 70, 72, 74, and 76 of the second stage 64 and then through the orifice 80 of the capillary unit 80-1, the particle beam enters evacuated region 102. The region 102 is evacuated by a pump 104 through pump connection 106 which functions to reduce the pressure in region 102 to, for example, 0.01 Torr and also to remove carrier gas remaining in the particle beam. Thus, the column 50-1 forms a particle flow wherein the atmospheric pressure aerosol is brought through aerodynamic lenses and through orifices into a region of intermediate pressure. Much of the gas is removed through the first pump 100 and the remaining particles are passed through another set of aerodynamic lenses and another orifice 80 before entering the evacuated region 102.

The second stage 64 may be provided with a pressure gauge 108 to confirm that the second stage 64 is under the proper intermediate pressure.

Ionization Device

Figure 4:
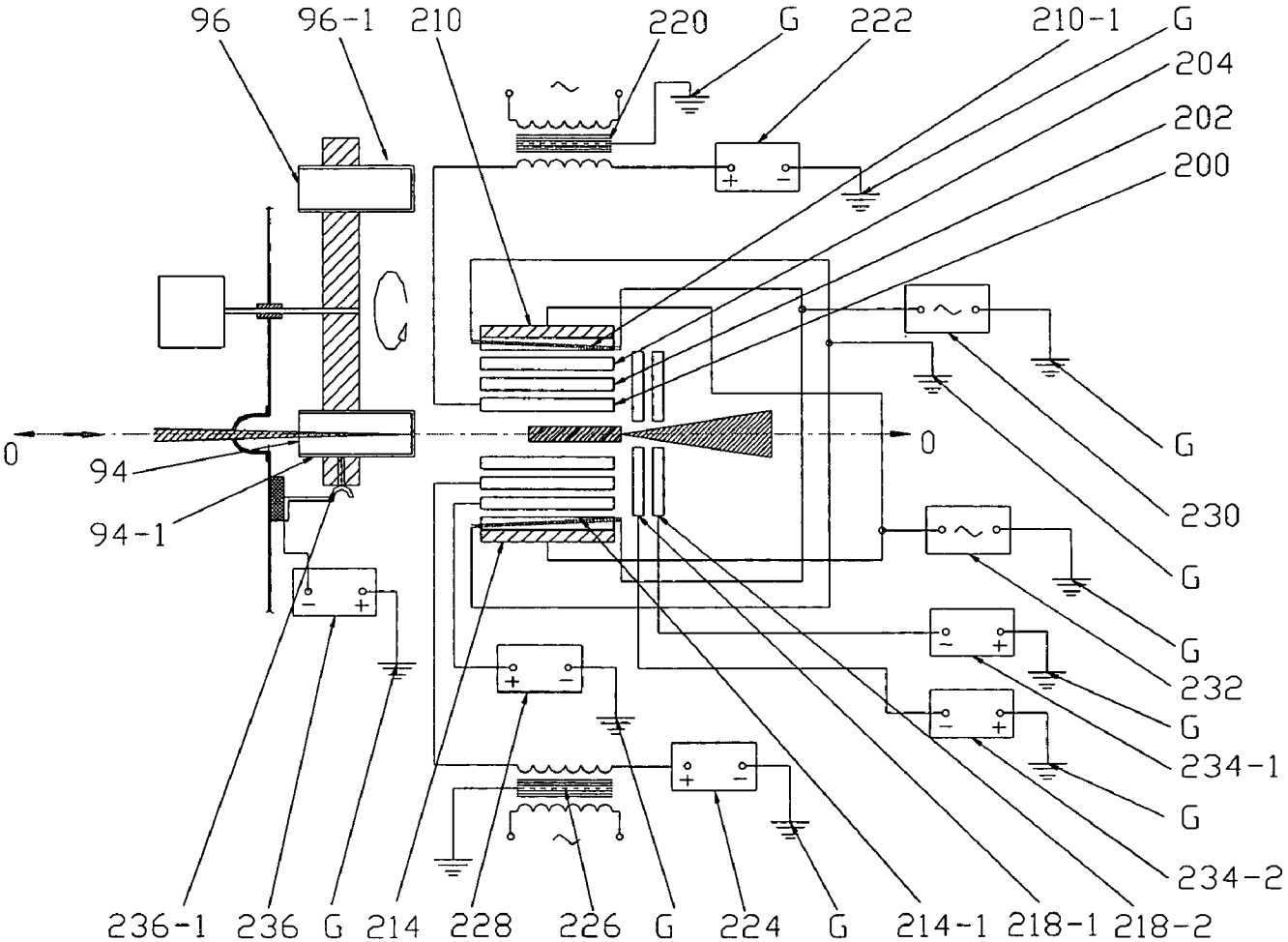
FIG. 4 is a cross-sectional view along the line IV—IV of FIG. 3A.

The ionization device 26 is shown in FIGS. 3A, 3B and 4, wherein FIG. 3A is a longitudinal sectional view that illustrates arrangement of units in the device 26, FIG. 3B is a cross-sectional view along the line IIIB—IIIB of FIG. 3, and FIG. 4 is the same view as FIG. 3A but with addition of electrical connections. The device contains the aforementioned rotary nozzle replacement system 86 located in a vacuum chamber 31 of the apparatus 20 (FIG. 1) on the front end of the ionization device 26. Reduced pressure in the vacuum chamber 31 is provided by a vacuum pump 29.

As shown in FIGS. 3A and 4, the rotary nozzle replacement system 86 comprises a revolving disk-like carrier 88, which has a plurality of circumferentially arranged and equally spaced recesses (only two of which, i.e., 90 and 92 are shown in FIG. 2) for holding output orifices (only two of which, i.e., 94 and 96 are shown). In spite of the fact that the droplets D were passed through a system of stages 62 and 64 (FIG. 2) with sets of aerodynamic lenses for cleaning, sorting, sizing, and spacing, they still may contain some contaminants. Therefore in conventional aerosol mass spectrometers the final orifices are often contaminated and clogged to such an extent that it becomes necessary to discontinue operation of the mass spectrometer and to clean or replace the orifice at the entrance to the mass spectrometer. This condition is especially unacceptable for aerosol TOF MS's that are intended for continuous operation over a long period of time for collection of information under critical conditions of finding sources of hazardous contaminations, or the like. The above objective is achieved by the use of the aforementioned rotary nozzle replacement system 86. When the orifice 94 (FIG. 3A) is contaminated or clogged, the revolving disk-like carrier 88 performs indexing rotation to the next angular position for aligning the next final orifice of the system 86 with the axis of the orifice 80 of the capillary unit 80-1, so that operation of the system may continue without interruption.

The next unit of the ionization device 26 arranged in the direction of the particle flow comprises three coaxial cylindrical bodies (FIGS. 3A, 3B, and 4), i.e., a central cylindrical body 200, an intermediate cylindrical body 202, and an external cylindrical body 204. As shown in FIG. 4, all cylindrical bodies have four aligned longitudinal slits on their outer surfaces, which extend in the directions parallel to the central axis of the cylindrical bodies. More specifically, the central cylindrical body 200 has slits 200-1, 200-2, 200-3, and 200-4; the intermediate cylindrical body has slits 202-1, 202-2, 202-3, and 202-4; and the external cylindrical body 204 has slits 204-1, 204-2, 204-3, and 204-4. Thus, the silts divide each cylindrical bodies into four concave segments with the concave sides facing the central axis O—O (FIG. 3).

Each three radially aligned slits of all three cylindrical bodies form an electrostatic slit lens. For example, the slits 200-1, 202-1, and 204-1 form an electrostatic slit lens 206; the slits 200-2, 202-2, and 204-2 form an electrostatic slit lens 208; etc.

The device 26 is provided with four elongated electron guns 210, 212, 214, and 216, which are located outside the external cylindrical body 204 in alignment with each set of three slits. The segments of the external electrodes 204 are connected to a positive terminal of a high-voltage power source (not shown) and serves as an anode for the aforementioned electron guns 210, 212, 214, and 216.

(26). The slit lenses 206, 208, etc. focus each electron beam emitted by the respective electron guns 210, 212, etc. on the axis O—O of the ionization and beam-focusing unit 26. The slits 202-1, 202-2, 202-3, and 202-4 focus respective electron beams B1, B2, B3, and B4 (FIG. 3B) onto the axis O—O (FIG. 4) of the device 26 and decelerate the electrons for precise control of the ionization of particles to prevent partitioning. Each electron gun 210, 212, 214, and 216 consists of a tungsten filament (FIG. 3B) 210-1, 212-1, 214-1, and 216-1 immersed in the respective slit 210-2, 212-2, 214-2, and 216-2 of the control electrode on the respective electron gun 210, 212, 214, and 216.

The central cylindrical body 200, which is connected to a source of an adjustable potential positive relative to the filament, serves as an electron-energy control member for precisely controlling and selecting the energy of electrons that reach O—O axis. This is required for selecting such electron energy that provides the maximal cross section of ionization of the droplet substance.

Figure 5:
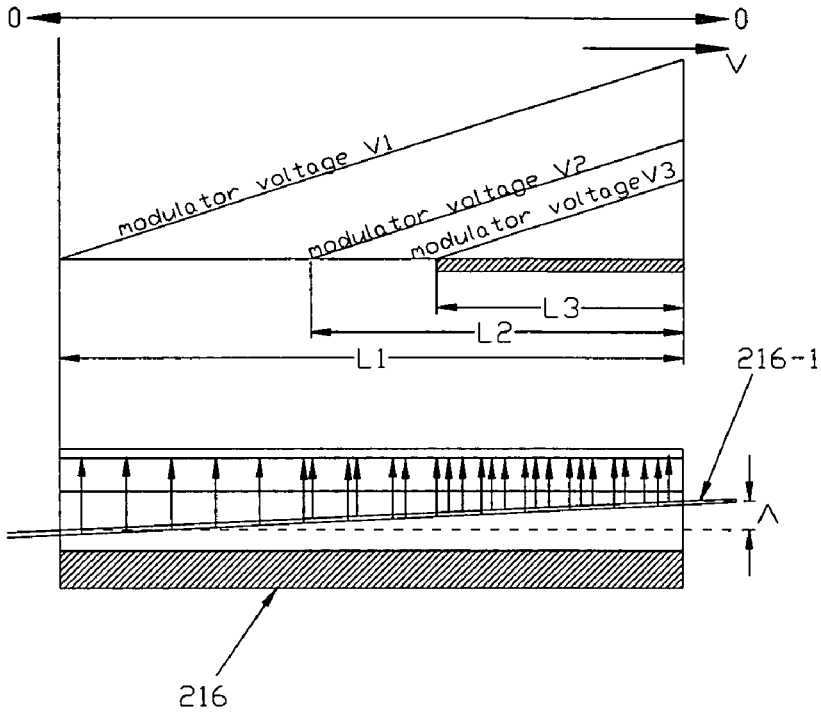
FIG. 5 is a graph illustrating change in the depth of immersion in the direction of flow of particles passing through the ionization device of FIGS. 3*a*, 3B, and 4.

A small positive volume charge is formed along the axis O—O of the device 26. A radial gradient of this charge will depend on current of electrons, density of the focused beam in the vicinity of the axis, and the total density of the charges on the focused beams. Since in the ionization and beam-focusing unit 26 the current density can be adjusted by changing the aforementioned filament immersion, this feature allows stabilization of the space charge in the direction of axis O—O. This is very important, since the axial gradient developed by the increase in emission along the axis O—O secures the motion of ions with the low energy 0.04 eV in the right direction and prevents their storage in the device 26 as a source of the space spread which normally reduces sensitivity in conventional TOF-MS's. Due to the radial gradient of the density of the volume charge, particles of the aerosol beam D ionized by the electron beams B1, . . . B4 can roll down into the potential hole, which is shown in FIG. 5, whereby a narrow ion stream IN is formed (FIG. 3B). FIG. 5 is a graph illustrating changes in the depth of immersion in the direction of flow. It can be seen that the depth of immersion A decreases along the slit in the direction of droplets flow shown by arrow V. As a result, the electron emission and a radial electron current taken from a unit length of the filament in the O—O direction increase in the O—O direction. In fact, for a given flight velocity of particles through the zone of ionization, the length L3 shown in FIG. 5 corresponds to the length of the zone of ionization and defines the so-called residence time of a particle in the aforementioned zone of ionization. The residence time, in turn, defines probability of ionization. In the subsequent text, this characteristic will be described as "residence time".

Figure 6:
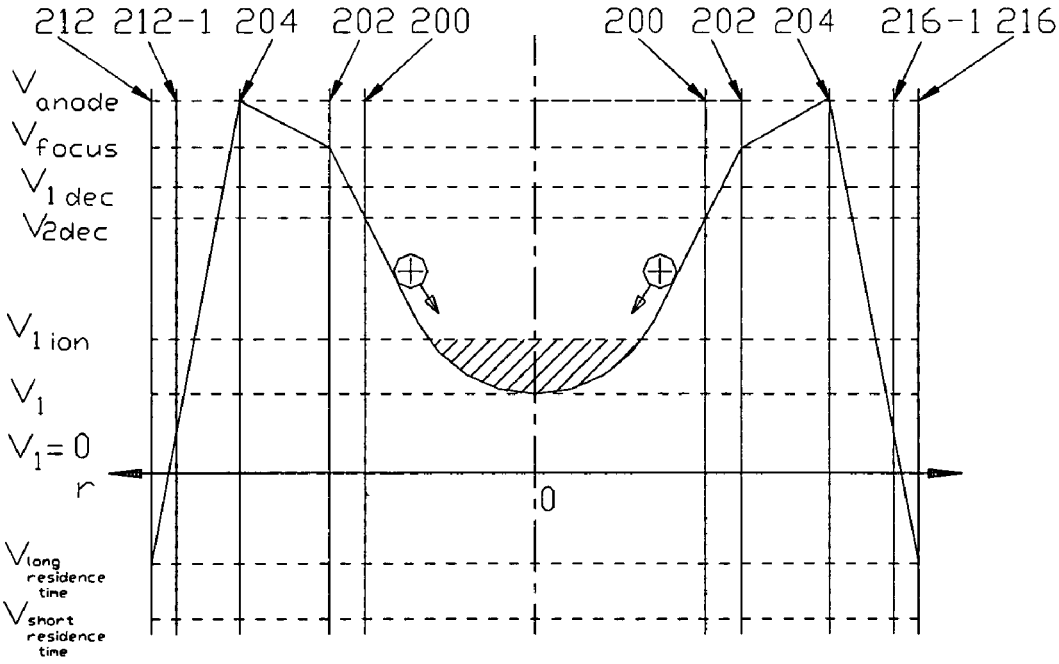
FIG. 6 is a graph that shows distribution of potentials on the three cylindrical bodies, electrodes of the electron guns, and in the flow of droplets in the ionization device of FIGS. 3*a*, 3B, and 4.

For better understanding the effect of inclination of the tungsten filament (FIGS. 3B and 4) 210-1, 212-1, 214-1, and 216-1 on the residence time of the particles in the ionization portion of the device 26, let us refer to FIG. 3B and FIG. 6, wherein FIG. 6 shows distribution of potentials on aforementioned three cylindrical bodies 200, 202, and 204, on the electrodes of the electron guns 210, 212, 214, and 216, and in the flow of droplets D that passes along the axis O—O in the center of the central cylindrical body 200. Plotted on the abscissa axis of the graph of FIG. 6 are positions of the electrodes 200, 202, and 204 and of the respective pair of the electron gun in one of cross sections of the cylindrical bodies, e.g., in a cross-section shown in FIG. 4. The coordinate origin coincides with the position on the axis O—O. The ordinate axis of the graph of FIG. 6 shows time-averaged potentials on the electrodes 200, 202, and 204 at a certain moment of time (some of the electrodes are supplied with modulated high voltage and with a low depth of modulation).

As shown in FIG. 4, the central cylindrical body or central electrode 200 is connected via a winding of a modulation transformer 220 to a positive terminal of a high-voltage DC power supply unit 222. In order to impart to the slits 202-1, 202-2, 202-3, and 202-4 combined with the anode slits 204-1, 204-2-, 204-3, and 204-4 the aforementioned focusing functions, the intermediate cylindrical body is connected to an adjustable high-voltage power supply 224. A positive terminal of the adjustable high-voltage power supply 224 is connected to the intermediate cylindrical body 202 via the winding of a modulation transformer 226. Frequency of modulation via the transformers 220 and 226 can vary in a wide frequency range, e.g., from several Hz to several KHz. The external cylindrical body or electrode 204 is connected to the positive terminal of an adjustable high-voltage power supply 228. All negative terminals of the aforementioned power supplies are grounded. The tungsten filaments (FIG. 4) 210-1, 212-1, 214-1, and 216-1 (only two of which, i.e., 210-1 and 214-1, are shown in FIG. 4) are connected to a source of AC voltage 230.

Bodies of electron gun 210, 212, 214, and 216 with respectiveslits 210-2, 212-2, 214-2, and 216-2 are made in the form of Wehnelt electrodes (only two of which, i.e., 210 and 214, are shown in FIG. 4). These electrodes are supplied with a modulation AC voltage from an AC voltage supply 232.

The aforementioned orifice 94 of the rotary nozzle replacement system 86 (FIG. 4) serves as an entrance diaphragm of the ionization device 26, while the set of two diaphragms 218-1 and 218-2 is used as an outlet of the ionization device 26 composed of the aforementioned three cylindrical bodies 200, 202, and 204 with the electron guns 210, 212, 214, and 216. These entrance and outlet diaphragms are maintained under a po218tential of a negative volume charge in order to prevent penetration of the external electrical fields into the ionizer and thus to prevent extraction of slow electrons from the space charge. This is important since such electrons compensate for the aforementioned space charge of positive particles. The diaphragms 218-1 and 218-2 are connected to power supplies 234-2 and 234-1, respectively, wherein the power supply 234-1 is an adjustable high-voltage power supply. The diaphragms 218-2 which is fed from the high-voltage power supply 234-1 functions as an accelerator for the charged particles that exit the ionizer. The positive terminals of the power supplies 234-1 and 234-2 are grounded.

The aforementioned output orifices (only two of which, i.e., 94 and 96 are shown in FIG. 4) are formed in metal sleeves, which are connected to a negative terminal of a power supply 236 via a sliding current collector 236-1. This potential fulfils the same function and the potential supplied to the diaphragm 218-1.

Thus, the ionization device transforms the flow of substantially neutral droplets D that enter this device into a slightly diverged flow of ionized droplets D. For matching with the entrance of the aerosol TOF MS unit 32, the flow of ionized droplets D should be focused, aligned, and time-modulated, with the TOF MS entrance.

The electron guns 210, 212, 214, and 216, filaments 210-1, 212-1, 214-1, and 216-1 aligned relative to the respective longitudinal slits 210-2, 212-2, 214-2, and 216-2 and inclined relative to the longitudinal axis, and source 230 of heating the filaments form means for adjusting the length L3 (FIG. 5) of the zone of ionization to conditions most optimal for the analyzed droplets. The aforementioned means for adjusting the length L3 provides a single-event ionization substantially of each of the particles since the length L3 is adjusted with reference to the velocities, compositions, natures, and masses of the particles. The term "single-event collision" means that the particles will not collide with the electron for the second time during the time of residence.

All devices of the aerosol TOF MS unit 32 operating in conjunction with the ionization device 26 of the present invention are located in a high-vacuum chamber 33 of the unit 32, which is evacuated with the use of a vacuum pump 35.

The functions of focusing, aligning, and time-modulating the ionized flow of droplets with the aerosol TOF MS unit 32 are accomplished by means of an ion-optic system 30 and a deflector modulator 239 with a steering deflector 238 (FIG. 1) which provides alternating deflections of the flow of particles between two positions F1 and F2 for aligning the flow with two inlet openings 256 and 258 into the TOF MS 32.

The construction, operation, and function of the ion-optic system 30, deflector modulator 239, steering deflector 238, aerosol TOF MS 32, and the rest of the aerosol mass spectrometer system are beyond the scope of the present invention and are shown for reference.

Operation

The ionization device 26 of the present invention operates as follows.

Since the mass spectrometer 32 for which the ionization device 26 is intended operates in a continuous mode, it is assumed that all parts of the system, including the ionization device, are energized, i.e., electron guns 210-2, 212-2, 214-2, and 216-2 are activated, the respective filaments 210-1, 212-1, 214-, and 216-1 are heated by resistance heat, and appropriate voltages are applied to the segments of the concentric cylindrical bodies that form the ionization unit so that electron beams that are intended for ionization of the droplets are formed and delivered to the ionization zone.

After passing through a system of stages 62 and 64 (FIG. 2) with sets of aerodynamic lenses for cleaning, sorting, sizing, and spacing, the droplets of the sample which is to be ionized are directed into the ionization device 26 through the orifice 94 of the rotary nozzle replacement system 86 which is aligned with the central longitudinal axis O—O of the ionization device (FIG. 3A).

When the flow of droplets D passes in the O—O axis direction through the ionization device 26, the droplets are subjected to the action of electron beams emitted by the electron guns 210-2, 212-2, 214-2, and 216-2 and directed onto the flow of particles by radially arranged slit lenses 206, 208, etc. that focus the electron beams onto the flow of droplets and decelerate the electrons for optimization of their energy by applying an appropriate voltage to the slits of the internal cylindrical body 200.

As has been mentioned above, the central cylindrical body 200, which is connected to a source of an adjustable potential positive relative to the filament, serves as an electron-energy control member for precisely controlling and selecting the energy of electrons that reach O—O axis. This is required for selecting such electron energy that provides the maximal possible cross section of ionization of the droplet substance.

The magnitudes of voltages or potentials developed in the slits between the segments of the cylindrical bodies are shown in FIG. 6, where potentials applied to the electrodes are plotted on the ordinate axis and where abscissa axis shows positions of the slits formed by the electrodes relative to the O—O axis. The center of the coordinate (point O) is located in the center of the graph. Thus, the vertical lines which are arranged symmetrically on the right side and on the left side from the center of coordinate correspond respectively to the electrodes formed by the inner cylindrical body 200, the focusing electrode 202, the external anode electrode 204, the filaments 216-1 and 212-1, and the Wehnelt electrodes 216 and 212. The curve Q in FIG. 6 corresponds to distribution of the potential on all electrodes of the ionization device 26.

In FIG. 6, $V_f$ designates a constant zero potential on the electron-gun filaments; $V_{anode}$ designates a positive potential on the electrodes formed by the external cylindrical body (anode) 204; $V_{focus}$ designates a positive potential on the electrode formed by the intermediate cylindrical body 202; $V_{2\ dec}$ designates a positive potential on the electrodes formed by the inner cylindrical body (decelerator) 200; and $V_{1\ dec}$ shows the maximal range of variation of $V_{2\ dec}$.

The curve Q of FIG. 6 shows that distribution of potential in the radial direction of the ionization device 26 forms a typical potential hole for ions localized in the area defined by the walls of the potential hole which in FIG. 6 is represented by the curve Q. The ions generated by the collision of the electrons with the droplets are accumulated in the area limited by the curve Q. This will lead to the growth of a positive spatial charge. In the graph of FIG. 6, the value of the positive space charge is designated by $V_{1\ ion}$. If in the course of collision of the electrons with the droplets the concentration of ions in the potential hole could grow, $V_{1\ ion}$ would move towards the edges of the potential hole, i.e., toward $V_{anode}$. However, this does not take place for the followings reasons: since once collided, the electrons loose their energy; and collision also results in release of a slow electrons, a part of which may remain in the potential hole over an extended period of time. The electrons accumulated in the potential hole compensate a positive spatial charge created by the ions in the potential hole. However, they cannot provide complete compensation, and the flow of charged particles formed in the ionization device 26 has a small positive potential $V_{1\ ion}$ that normally does not exceed 10 V. In other words, $V_{1\ ion}$ is essentially lower than the potential on the edges of the potential hole, where $V_{anode}$ is about 100 V.

In order to impart to the slits 202-1, 202-2, 202-3, and 202-4 in combination with the anode slits 204-1, 204-2, 204-3, and 204-4 the aforementioned focusing functions, the intermediate cylindrical body 202 (FIG. 4) is connected to an adjustable high-voltage power supply 224. A positive terminal of the adjustable high-voltage power supply 224 is connected to the intermediate cylindrical body 202 via the winding of a modulation transformer 226. Frequency of modulation via the transformers 220 and 226 can vary in a wide frequency range, e.g., from several Hz to several KHz.

Variation of the positive potential on the intermediate cylindrical body 202 with the use of the modulation transformer 226 provides variation of focusing properties of the focusing lenses formed by the respective anodes of the external cylindrical body 204, the intermediate electrode 202 with respective anode slits 204-1, 204-2, 204-3, 204-4, and the intermediate electrode slits 202-1, 202-2, 202-3, 202-4. Variations in the position of the focus makes it possible to scan the flow of particles in the radial direction and in the plane of the flat electron beam.

Variation of the positive potential on the inner cylindrical body (decelerator) 200 with the use of the modulation transformer 220 provides variation of energy of electrons that entered the ionization zone inside the beam. This is because, depending on the mass, the particles to be charged will have different values of cross-sections of ionization and their energy dependence. Therefore, sweeping of the ionization energy will optimize the process of ionization.

Thus the ionization device 26 of the present invention maintains the flow of ionized particles in the state of equilibrium and stabilizes this flow in the radial direction. In order to limit the loss of the aforementioned slow electrons that compensate for the spatial charge of the ionized particles, it is necessary to prevent leakage of the electrons in the axial. In the device 26 of the invention, this is achieved by applying negative voltages to the units arranged on the end faces of the ionization unit, i.e., from the power supply 236 to the orifice 94 of the rotary nozzle replacement system 86 via the sliding contact 236-1 and from the power supply 234-2 to the diaphragm 218-1, which is used as an outlet of the ionization device 26.

As has been described above, when the flow of droplets passes through the ionization device, the residence time of the droplets is controlled via the amplitude of modulation of potential applied to the Wehnelt electrode.

Thus, the ionization device 26 transforms the flow of substantially neutral droplets D that enters this device into a slightly diverged flow of ionized droplets D that are emitted from the outlet of the ionization device to entrance of the aerosol TOF MS unit 32. This flow of ionized droplets D should be focused, aligned, and time-modulated, with the TOF MS entrance.

The functions of focusing, aligning, and time-modulating the ionized flow of droplets with the aerosol TOF MS unit 32 are accomplished by means of an ion-optic system 30 and a deflector modulator 239 with a steering deflector 238 (FIG. 1) which provides alternating deflections of the flow of particles between two positions F1 and F2 for aligning the flow with two inlet openings 256 and 258 into the TOF MS 32. As has been mentioned above, these units are beyond the scope of the present invention.

Thus, it has been shown that the invention provides an ionization device which: is applicable for use in an aerosol mass spectrometer operating in real time and allows control of the residence time of particles while they are ionized in the ionization device; does not destroy multimolecular particles which are to be analyzed; ensures single-time charging of the particles; and identifies particles by masses in a wide range of mass variations from molecules, molecule fragments of complex compounds to multimolecular compounds and particles.

Although the invention has been shown and described with reference to specific embodiments, it is understood that these embodiments should not be construed as limiting the areas of application of the invention and that any changes and modifications are possible, provided these changes and modifications do not depart from the scope of the attached patent claims. For example, the radial-cylindrical electron optics is not necessarily formed by three slits and the number of the slits may be smaller or greater than three. The principle of the invention will not be violated if only one electron gun is used in connection with a sequence of aligned slits. The principle of trapping electrons in the axial direction may be different from that described in the application. Modulation used for controlling residence time of particles in the ionization zone can be carried by means other than modulation of voltage applied to the Wehnelt electrode. For example, modulation can be carried out via the anode. Inclination of the filament can be adjustable. The electron guns can be of the type with hot cathodes where the filament is heated by indirect heating means, e.g., by placing it into a helical heating element.

What is claimed is:

1. An ionization device for ionization of particles in the form of a flow in a direction of propagation of said particles comprising:

a sealed vacuum chamber in which said ionization device is located;

at least one hollow cylindrical body having a central longitudinal axis and a longitudinal slit having a length, said flow of said particles coinciding with said central longitudinal axis;

a source of electrons located outside said at least one hollow cylindrical body to form an electron beam directed onto said flow of particles through said longitudinal slit in the direction perpendicular to said direction of propagation;

means for application of a positive voltage to said at least one hollow cylindrical body to form an anode slit for said electron beam; and a zone of ionization of said particles that has a length and is arranged on said longitudinal axis.

2. The ionization device of claim 1, further comprising means for adjusting said length of said zone of ionization from the lengths of said slit to a part of the length of said slit.

3. The ionization device of claim 2, wherein said source of electrons comprises an electron gun having an outer electrode with means for application of an alternating potential with an adjustable amplitude to said outer electrode; said means for adjusting said length of said zone of ionization comprises: said electron gun; an elongated conductive body aligned with said longitudinal slit and inclined with respect to said longitudinal axis; and a source of heating said elongated conductive body.

4. The ionization device of claim 1, wherein said at least one hollow cylindrical body has end faces, said ionization device further comprising means for retaining said electrons in said ionization device against leakage outside said ionization device through at least one of said end faces, said means for retaining said electrons being located outside at least one of said end faces and in a close proximity thereto.

5. The ionization device of claim 4, wherein said means for retaining said electrons in said ionization device comprises at least one conductive body which is connected to a source of a negative potential.

6. The ionization device of claim 2, wherein said at least one hollow cylindrical body has end faces, said ionization device further comprising means for retaining said electrons in said ionization device against leakage outside said ionization device through at least one of said end faces, said means for retaining said electrons being located outside at least one of said end faces and in a close proximity thereto.

7. The ionization device of claim 6, wherein said means for retaining said electrons in said ionization device comprises at least one conductive body which is connected to a source of a negative potential.

8. The ionization device of claim 3, wherein said at least one hollow cylindrical body has end faces, said ionization device further comprising means for retaining said electrons in said ionization device against leakage outside said ionization device through at least one of said end faces, said means for retaining said electrons being located outside at least one of said end faces and in a close proximity thereto.

9. The ionization device of claim 8, wherein said means for retaining said electrons in said ionization device comprises at least one conductive body which is connected to a source of a negative potential.

10. An ionization device for ionization of particles in the form of a flow in a direction of propagation of said particles comprising:

a sealed vacuum chamber in which said ionization device is located;

at least three concentric hollow cylindrical bodies comprising an inner hollow cylindrical body, an intermediate hollow cylindrical body, and an external hollow cylindrical body;

at least one longitudinal slit in each of said three concentric cylindrical bodies, said at least one longitudinal slit of each of said three hollow cylindrical bodies being aligned with the positions of said at least one longitudinal slit in other of said three concentric hollow cylindrical bodies of said plurality;

means for application of positive potentials to each of said hollow cylindrical bodies with gradual decrease in the value of said positive potentials in the direction from said external cylindrical body towards said inner cylindrical body;

a source of electrons located outside of said external cylindrical body in alignment with said at least one longitudinal slit for forming an electron beam directed onto said flow of particles through said at least one longitudinal slit in the direction perpendicular to said direction of propagation; and a zone of ionization of said particles that has a length and is arranged on said longitudinal axis.

11. The ionization device of claim 10, further comprising means for adjusting said length of said zone of ionization from the lengths of said at least one slit to a part of the length of said at least one slit.

12. The ionization device of claim 11, wherein said source of electrons comprises an electron gun having an outer electrode with means for application of an alternating potential with an adjustable amplitude to said outer electrode; said means for adjusting said length of said zone of ionization comprises: said electron gun; an elongated conductive body aligned with said longitudinal slit and inclined with respect to said longitudinal axis; and a source of heating said elongated conductive body.

13. The ionization device of claim 1, wherein said at least three hollow cylindrical bodies have end faces, said ionization device further comprising means for retaining said electrons in said ionization device against leakage outside said ionization device through at least one of said end faces, said means for retaining said electrons being located outside at least one of said end faces and in a close proximity thereto.

14. The ionization device of claim 13, wherein said means for retaining said electrons in said ionization device comprises at least one conductive body which is connected to a source of a negative potential.

15. The ionization device of claim 10, wherein said vacuum chamber is provided with an inlet port for admission of said flow of particles to said ionization device; said ionization device further comprising particle guiding means directing said flow of particles to said ionization device along said direction of propagation; said particle guiding means being located inside said vacuum chamber and in front of one of said end faces which is nearest to said particle guiding means; said particle guiding means comprising a mechanism with a plurality of replaceable orifices that can be aligned with said direction of propagation and replaced without interrupting operation of said ionization device.

16. The ionization device of claim 12, wherein said vacuum chamber is provided with an inlet port for admission of said flow of particles to said ionization device; said ionization device further comprising particle guiding means directing said flow of particles to said ionization device along said direction of propagation; said particle guiding means being located inside said vacuum chamber and in front of one of said end faces which is nearest to said particle guiding means; said particle guiding means comprising a mechanism with a plurality of replaceable orifices that can be aligned with said direction of propagation and replaced without interrupting operation of said ionization device.

17. The ionization device of claim 14, wherein said vacuum chamber is provided with an inlet port for admission of said flow of particles to said ionization device; said ionization device further comprising particle guiding means directing said flow of particles to said ionization device along said direction of propagation; said particle guiding means being located inside said vacuum chamber and in front of one of said end faces which is nearest to said particle guiding means; said particle guiding means comprising a mechanism with a plurality of replaceable orifices that can be aligned with said direction of propagation and replaced without interrupting operation of said ionization device.

18. The ionization device of claim 10, further comprising: means for periodic variation of said positive potential on said intermediate cylindrical body with an adjustable frequency.

19. The ionization device of claim 12, further comprising: means for periodic variation of said positive potential on said intermediate cylindrical body with an adjustable frequency.

20. The ionization device of claim 14, further comprising: means for periodic variation of said positive potential on said intermediate cylindrical body with an adjustable frequency.

21. The ionization device of claim 10, further comprising means for periodic variation of said positive potential on said inner cylindrical body with an adjustable frequency.

22. The ionization device of claim 12, further comprising means for periodic variation of said positive potential on said inner cylindrical body with an adjustable frequency.

23. The ionization device of claim 14, further comprising means for periodic variation of said positive potential on said inner cylindrical body with an adjustable frequency.

24. The ionization device of claim 20, further comprising means for periodic variation of said positive potential on said inner cylindrical body with an adjustable frequency.

25. The ionization device of claim 21, further comprising means for periodic variation of said positive potential on said inner cylindrical body with an adjustable frequency.

26. A method for ionization of particles in the form of a flow in a direction of propagation of said particles, said particles having different velocities, composition, and masses, said method comprising the steps of:

providing an ionization device for ionization of said flow of particles by means of a beam of electrons directed onto said flow of particles, said electrons having energy, said flow of particles having a longitudinal axis that coincides with said direction of propagation, said beam having a focus on said longitudinal axis, said ionization device having a length in said direction of propagation, and a zone of ionization which has a length and is located on said longitudinal axis; and providing a single-event ionization substantially of each of said particles by adjusting said length of said zone of ionization from said lengths of said ionization device to a part of said length of said ionization depending on said velocities, compositions, natures, and masses of said particles.

27. The method of claim 26, further comprising the steps of:

providing said ionization device with a mechanism having a plurality of replaceable orifices used for admitting said flow of said particles into said ionization device by passing said particles through one of said orifices;

aligning said one of said orifices with said direction of propagation; and replacing said one of said orifices with another orifice when said one of said orifices is clogged.

28. The method of claim 26, further comprising the step of periodically varying position of said focus with an adjustable frequency.

29. The method of claim 27, further comprising the step of periodically varying position of said focus with an adjustable frequency.

30. The method of claim 26, further comprising the step of periodically varying said energy of said electrons.

31. The method of claim 27, further comprising the step of periodically varying said energy of said electrons.

32. The method of claim 28, further comprising the step of periodically varying said energy of said electrons.

33. The method of claim 30, further comprising the step of periodically varying said energy of said electrons.

* * * * *